US009221088B2

(12) United States Patent
Madhavan et al.

(10) Patent No.: US 9,221,088 B2
(45) Date of Patent: Dec. 29, 2015

(54) STRETCH ROLL FORMING

(75) Inventors: Vis Madhavan, Wichita, KS (US); Mahdi Saket, Wichita, KS (US)

(73) Assignee: FAIRMONT TECHNOLOGIES, LLC, Wichita, KS (US)

( * ) Notice: Subject to any disclaimer, the term of this patent is extended or adjusted under 35 U.S.C. 154(b) by 531 days.

(21) Appl. No.: 12/763,819

(22) Filed: Apr. 20, 2010

(65) Prior Publication Data

US 2010/0263424 A1 Oct. 21, 2010

Related U.S. Application Data

(60) Provisional application No. 61/171,247, filed on Apr. 21, 2009.

(51) Int. Cl.

| | |
|---|---|
| ***B21D 1/05*** | (2006.01) |
| ***B21D 5/08*** | (2006.01) |
| ***B21D 11/02*** | (2006.01) |
| *B21D 5/14* | (2006.01) |
| *B21D 43/08* | (2006.01) |
| *B21D 43/09* | (2006.01) |
| *B21D 1/02* | (2006.01) |
| *B21D 5/06* | (2006.01) |

(52) U.S. Cl.

CPC *B21D 5/08* (2013.01); *B21D 11/02* (2013.01); *B21D 1/02* (2013.01); *B21D 1/05* (2013.01); *B21D 5/06* (2013.01); *B21D 5/14* (2013.01); *B21D 43/08* (2013.01); *B21D 43/09* (2013.01)

(58) Field of Classification Search

CPC ..... B21D 1/02; B21D 1/05; B21D 5/06; B21D 5/08; B21D 5/14; B21D 11/02; B21D 43/08; B21D 43/09

USPC ..... 72/166, 377, 167, 127, 302, 422, 169, 72/176, 178, 250, 251, 296, 292, 303, 205, 72/226, 227, 231, 234, 240, 242.2, 243.2, 72/243.4, 8.1, 10.1, 10.2, 10.3, 10.4, 64, 72/65, 299; 100/151; 226/4, 111, 189

See application file for complete search history.

(56) References Cited

U.S. PATENT DOCUMENTS

| | | | | | |
|---|---|---|---|---|---|
| 2,166,418 | A | * | 7/1939 | McBain | 72/146 |
| 2,212,132 | A | * | 8/1940 | Shear | 57/138 |
| 2,569,266 | A | * | 9/1951 | Thompson | 72/166 |
| 2,761,633 | A | * | 9/1956 | Sindzinski | 406/77 |
| 2,922,324 | A | * | 1/1960 | Honerkamp et al. | 72/12.8 |
| 3,182,877 | A | * | 5/1965 | Slator et al. | 226/172 |
| 3,285,485 | A | * | 11/1966 | Slator | 226/172 |
| 3,349,981 | A | * | 10/1967 | Hawkins et al. | 226/155 |

(Continued)

FOREIGN PATENT DOCUMENTS

| | | | | | |
|---|---|---|---|---|---|
| JP | 06297044 | A | * | 10/1994 | B21D 7/08 |
| JP | 08187516 | A | * | 7/1996 | B21D 5/10 |
| WO | WO 2008043605 | A2 | * | 4/2008 | |

OTHER PUBLICATIONS

Halmos, George T., Roll Forming Handbook, 2006, pp. 4-26-4-34, 15-6-15-7 (13 pages), CRC Press Taylor & Francis Group, Boca Raton.

*Primary Examiner* — Shelley Self
*Assistant Examiner* — Chwen-Wei Su
(74) *Attorney, Agent, or Firm* — Maier & Maier, PLLC

(57) ABSTRACT

A method of forming includes applying a stretching force along a linear axis of a work piece and forming the work piece while the stretching force is applied.

2 Claims, 12 Drawing Sheets

(56) References Cited

U.S. PATENT DOCUMENTS

| | | | | | |
|---|---|---|---|---|---|
| 3,683,653 | A | * | 8/1972 | Cox | 72/10.2 |
| 3,742,748 | A | * | 7/1973 | Ehm | 72/166 |
| 3,862,559 | A | * | 1/1975 | Richter et al. | 72/205 |
| 3,867,826 | A | * | 2/1975 | Noe | 72/205 |
| 4,002,048 | A | * | 1/1977 | Pozsgay | 72/205 |
| 4,086,800 | A | * | 5/1978 | Demny et al. | 72/205 |
| 4,388,819 | A | * | 6/1983 | Moltner | 72/234 |
| 4,833,904 | A | * | 5/1989 | Mainiero | 72/11.2 |
| 4,850,212 | A | * | 7/1989 | Frey | 72/166 |
| 4,921,037 | A | * | 5/1990 | Bergeron et al. | 164/432 |
| 5,094,340 | A | * | 3/1992 | Avakov | 198/626.1 |
| 5,421,951 | A | * | 6/1995 | Troutner et al. | 156/580 |
| 5,458,477 | A | * | 10/1995 | Kemerer et al. | 425/371 |
| 6,925,845 | B2 | * | 8/2005 | Behrens et al. | 72/161 |

* cited by examiner

STRETCH ROLL FORMING

This application claims the benefit of U.S. Provisional Application Ser. No. 61/171,247, filed Apr. 21, 2009 and entitled Stretch Roll Forming.

FIELD OF THE INVENTION

The present invention relates to a method and apparatus for forming metal.

BACKGROUND OF THE INVENTION

Complex curved metal components are formed to a desired shape by the mechanical action of dies (roll forming) or by application of other external forces, such as stretching, hydraulic fluid, induction coils, etc. In most roll forming processes, unique sets of dies need to be fabricated and used for each specific forming operation of each part. Moreover, many shapes require at least one additional shaping process in order to achieve the desired shape, such as stretch forming. This increases the cost and lead time of production. The U.S. patent to Gerald Hackstock, U.S. Pat. No. 6,286,352, entitled Stretch Roll Forming Apparatus Using Frusto-Conical Rolls is exemplary of the effort to combine the roll and stretch forming processes into a single process.

It is therefore the primary objective of the present invention to provide apparatus and a method for improved material forming utilizing roll dies and stretching techniques simultaneously.

SUMMARY OF THE INVENTION

Prior to introducing the general and specific teachings of the present invention, some general observations about the physics of metal forming will assist in the understanding of the present invention.

While in mechanics traction is typically used to refer to both the normal and tangential forces exerted over a surface element, since the object of the invention is to provide for methods of applying substantial forces tangential to the surface, for the purpose of clarity, in this application the usage "traction" or "traction force" refers exclusively to the component of forces applied on a surface that are substantially tangential to the surface $F_t$. The maximum value of the traction force that can be exerted over a surface element typically is the product of the normal force applied $F_n$ and the coefficient of friction between the means of applying the normal and traction forces and the surface with which said means is in contact to apply the normal and traction forces. "Normal stress" $\sigma_n$ refers to the normal force per unit area of the surface. "Traction stress" refers to the traction force per unit area of the surface. If the traction force were uniformly applied over the surface element, the local traction stress at any point within the surface element would be the same as the average traction stress. The traction stress at the surface is a shear stress that in many cases decreases at points away from the surface, deeper inside the body. If the body is in static equilibrium under the action of the forces imposed on it, this gradient of shear stress causes a tangential stress $\sigma_x$ within the body in a direction perpendicular to the surface normal.

If opposing normal forces are applied over opposite faces of a body, the body would be in equilibrium due to the normal forces canceling each other. However, the body would be subjected to compressive stress equal to $\sigma_n$. The maximum normal force that can be applied is limited by the ability of the body to withstand the compressive stress without yielding.

The magnitude of the compressive stress sustainable may be limited by other stresses in the body. For instance, if there is a tangential tensile stress $\sigma_x$ along the direction parallel to the surface (say this is along the length direction of a flat extrusion), equal to 50% of the yield strength (Y) of the material of the body and if the normal stress applied at the contact equals 50% of the yield strength, the body would begin to yield. If there is no stress in the third direction (along the surface, perpendicular to the tensile stress, then the plastic strain in the body would be tensile along the tension direction ($\epsilon_{\downarrow}x>0$) and compressive along the normal direction $[(\epsilon]_n<0$). If at the contact, a traction stress were applied in addition to the normal stress (say the traction stress is equal to ½ the normal stress ($\tau=\sigma_{\downarrow}n/2$), then the body would begin to yield even before the normal stress equals 50% of the yield strength. Using Tresca's criterion, the normal stress would be about 29% of the yield stress when yielding begins. However, if the normal and traction stresses were applied over a width which is at least equal to the thickness of the body, the bulk of the body would begin to yield when the normal stress reaches about 25% of the yield stress.

Taking into account the effect of the traction on increasing the tangential stress (tensile stress parallel to the surface is equal to the increased value on the right side of the contact) it can be seen that yielding will actually begin at the top right corner of the contact even before the normal stress reaches 25% (actually at 23.6%) of the yield stress. Thus it is likely that there may always be a little more strain at the contact surfaces than subsurface and will lead to the burnishing effect identified earlier. The magnitude of this can be controlled by spreading the normal and traction forces over different distances, that is, changing the stresses $\sigma_n$ and $\tau$.

The above description and conclusions are true at all grips acting to apply a tensile stress within a body. For instance, at the grips which grip a tension test specimen in a tensile tester, or at the grips which grip a sheet in a drape forming press, or at the grips which grip an extrusion in an extrusion stretch press, if the specimen gripped had a uniform cross section (like in the last two examples above) and the grips were to attempt to stretch the specimen to yielding, it will be seen that the end of the contact between the grip and the specimen is where the effective stress is greatest, causing the material to yield first there.

Grasping a specimen via rollers, so that the specimen moves with respect to the grips, causes the stretch as well as the burnishing strains to be uniformly spread throughout the specimen, permitting much more strain, hardening and compressive residual stress on the surface, thereby leading to an overall lighter and stronger part.

Normal and traction stresses may be applied to a body on only one surface and not on the opposite surface. Depending on the configuration of the body, this may lead to other effects such as a bending moment.

The present invention is based on the concept that sets of rollers can be mounted on suitable mechanisms and used as reconfigurable 'dies' that guide the formation of parts into desired shapes. The same rollers, when suitable driving torque is applied to them, are also used to stretch the part while it is being formed. The stretch-roll aspect of the forming operation also includes bending of the metal work piece while a tensile force is exerted on it. In operation, the work piece may be a sheet or a structural section such as a T-section or pipe. The work piece is formed using a plurality of roller sets that exert a tensile force on the work piece to form it into a desired shape. The tensile loading that is exerted while forming the part reduces spring back and residual stresses in the fabricated component. The stretch of the work piece is controlled by the rotational speed of the roller sets and the torque on the rollers. The position and orientation of the roller sets is dynamically configured in one or more planes to control and vary the contour along the length of the work piece. Sensors provide feedback to adaptively measure and control the stretch in each section of the work piece as well as its geometry.

The advantage of using many sets of relatively small rollers to stretch components, as opposed to using two big rolls on opposite sides to grip a part and pull it in opposite directions, as shown in the Hackstock patent, U.S. Pat. No. 6,286,352, is that each contact between a roller and the component can be small. Thus, normal and stretch forces can be transmitted into curved parts of a work piece without flattening them out. The small stretch forces exerted by each roller set add cumulatively, leading to stretch forces large enough to stretch parts plastically.

The process of using multiple sets of rollers to grasp and stretch curved parts without flattening them can be employed with tractor elements which apply normal and stretch forces over larger contiguous areas of the sheet.

At each point of contact, the curvature of the tractor element matches the desired curvature of the part. This is accomplished using die segments for parts of constant curvature. For parts with variable curvature along the stretch direction, this can be accomplished using "flexible raceways". Additionally, for parts with a gentle curvature, tractor elements of a different curvature, or no curvature, clamp over finite lengths of the part to establish the stretch in regions away from the section where the stretch is greatest and where the bending is expected to be done. The maximum permissible length of a tractor element depends on the difference in curvature, thickness of the rubber tractor belt used and the maximum bending moment that the section can withstand while still being elastic, which depends on the stretch level that exists at that particular section. For example, tractor elements of 4 ft radius may be able to exert most of the stretch force, even if the radius of curvature of the part is 4.5 feet. The advantage of tractor elements is that much larger stretch forces can be generated while grasping the part over a limited length. In the following specification and claims, when rollers or roll sets are referenced it, it should be inferred to include tractor elements.

DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Roll forming is a fabrication process of forming a work piece to a desired geometry by applying suitable forces by a plurality of roller stations that are precisely located and shaped with respect to a work piece. Forming is accomplished by relative motion between the work piece and a plurality of roller stations. The work piece can be sheet stock or a segment of stock of some preformed shape. In the stretch roll forming of the present invention, specific torque is applied to one or more of the rollers to cause a stretch that assists in forming the part into the desired shape while at the same time reducing residual stress in the work piece.

Figure 1:
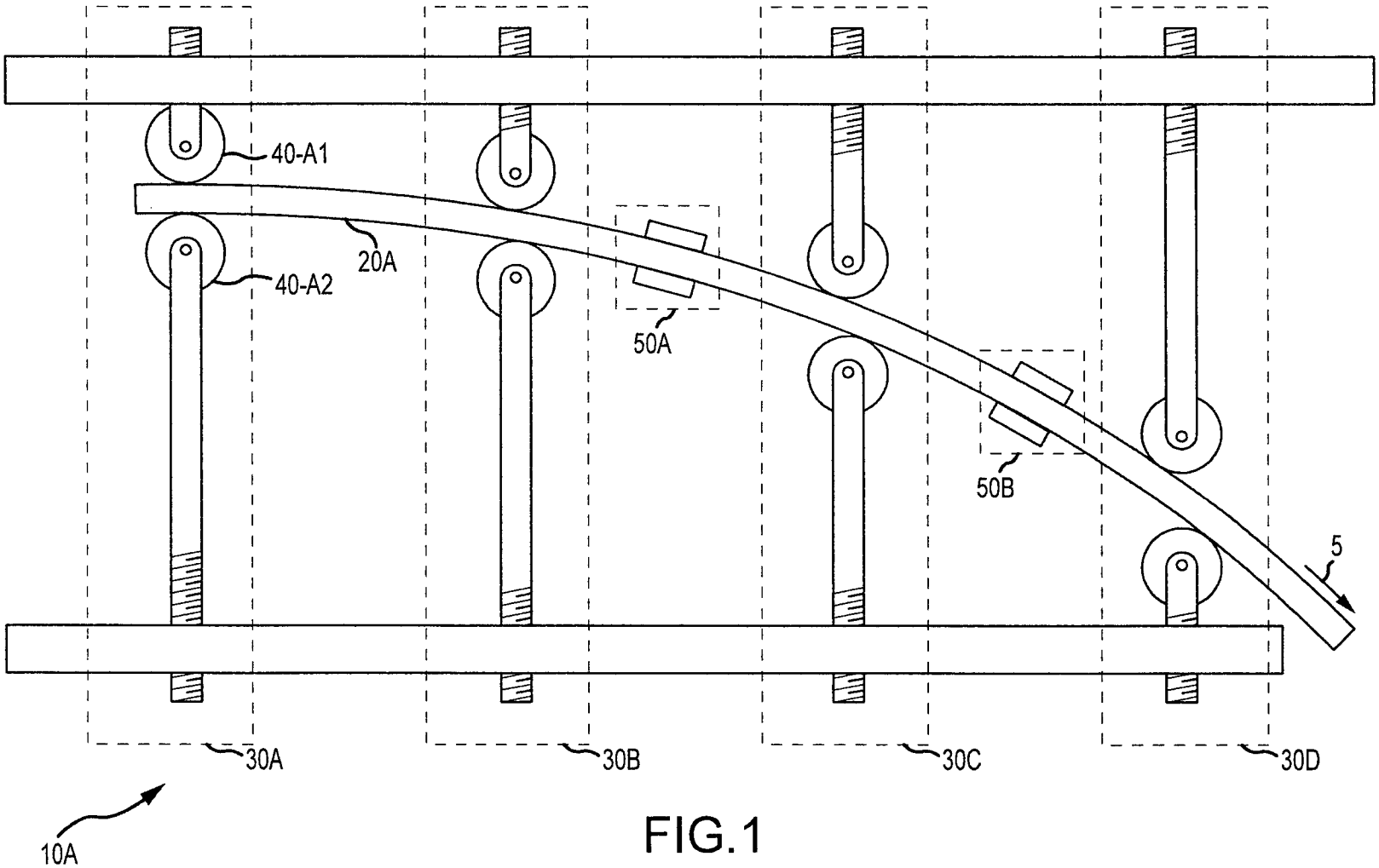
FIG. 1 illustrates consecutive sets of rollers.

FIG. 1 illustrates the basic system 10A of the present invention. Each of a plurality of sequentially arranged roller stations 30A, 30B, 30C, and 30D includes a set of rollers, each set having at least two rollers where a roller is sometimes referred to as a die.

In the embodiment illustrated in FIG. 1, a flat strip is stretched and formed to a radius. Each roller station includes two rollers on opposite sides of work piece 20A, for instance, roller station 30A includes rollers 40-A1 and 40-A2. Work piece 20A is formed while traveling in the direction of arrow 5. The force applied by the rollers in roller stations 30A and 30B are in a manner to oppose the flow of work piece 20A. The forces applied by roller stations 30C and 30D are controlled to oppose the force exerted by roller stations 30A and 30B and to provide a small additional amount of forming force. More specifically, roller stations 30A and 30B have clockwise torque applied to the upper rollers and counterclockwise torque applied to the lower rollers, resulting in a tensile force acting to pull the work piece 20A to the left, while roller stations 30C and 30D have opposite torque applied to their rollers that exerts a tensile force pulling the work piece 20A to the right, akin to a tug-of-war. In the illustrated embodiment, roller station 30D is driven in a speed controlled mode and pulls the work piece 20A through from left to right.

Work piece 20A is propelled through system 10A by at least one powered roller of the system 10A. For example, roller 40-A1 can be powered and roller 40-A2 can be unpowered. More than one roller of system 10A may be powered. For example, roller station 30D may provide speed control to move the work piece through system 10A.

Work piece 20A can be a sheet of metal, a plate, an extrusion, a wire, a tube or other work piece. It may initially be in a flat form or coiled and after forming can be bent or straightened. In FIG. 1 the work piece 20A is initially straight and a radius is formed therein by passing it through system 10A. The radius has a curvature governed by the spacing and location of the individual roller stations. The curvature of the pathway through system 10A imparts a corresponding bend in the work piece 20A which is incrementally formed over a series of stations where each roller station imparts additional deflection or forming. In each pass through the system, the work piece is shaped between the two roller stations where the stretch is at a maximum and later roller stations (those to the right of FIG. 1) serve to unload work piece 20A without imparting additional forming. System 10A may be configured to form a particular curvature or to straighten a work piece. Three or more sets of roller stations are used to form a curve in a work piece and two or more roller stations are used to straighten a work piece.

The system 10A may remain stationary while the work piece travels in the direction shown by arrow 5. On the other hand, the system 10A may travel in a direction opposite that of arrow 5 while the work piece 20A remains stationary. A "pass" includes relative movement of the work piece and the system 10A.

Consider an example in which the tensile strength of the work piece has yield strength of 10,000 PSI and an ultimate strength of 15,000 PSI. In this example, a 5,000 pound tensile stress (stretch force per unit cross-section area) will allow forming the work piece with reduced residual stress and spring back. In general, increasing the tensile stress exerted while roll forming produces a formed work piece having reduced residual stress and reduced spring back. The amount of tensile stress may take on a value (above 10,000 PSI for the above example) such that the stretch may be in the range of 2% to 3% although other values are also contemplated.

The force applied by a particular roller can be controlled by a processor or other controller. In the case of a roller powered by a DC motor, the force can be controlled by modulating the current supply. A roller can be powered by an electric motor, a hydraulic motor, or other source of rotary power delivered directly or through a variety of power transmission means such as a gear, a chain, a belt, a shaft or other means.

In FIG. 1 sensors 50A and 50B provide an electrical output signal based on the measured strain in the work piece. At least one of the sensors may be an optical sensor to monitor the stretch between adjacent roller stations. Sensors 50A and 50B may include encoders that measure the rotation of selected rollers and a processor coupled to the sensors to determine the strain in the work piece using the difference in rotary speed. Each roller station may be followed by a sensor to monitor the stretch and to determine uniformity in a process control environment. Alternatively, both optical sensors 50A and 50B may directly measure the velocity of the sheet and encoders measure the rotation of the rolls in order to monitor the slip of the rollers with respect to the work piece and accordingly control the normal force exerted by the rollers on work piece.

In FIG. 1 the vertical positions of roller station 30A, 30B, 30C, and 30D are individually adjustable in order to provide the desired forming operation. Each roller station is threadingly adjustable on a vertical axis.

System 10A includes adjustable components to allow various forming operations including imparting a stretching force and performing roll forming. System 10A may be a component of a CNC (computer numeric control) machine.

Material with other cross-sections may be similarly stretch bent or stretch roll formed, as illustrates in other Figures of the attached drawings. The rollers at each roller station may include additional rollers that are positioned around the work piece and at different positions along work piece 20A. The rollers may be arranged in pairs.

Figure 2A:
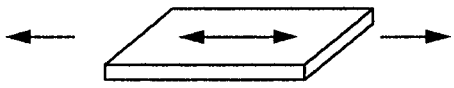
FIGS. 2A, 2B, and 2C illustrate formed work pieces.
Figure 2B:
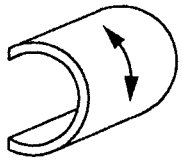
Figure 2C:
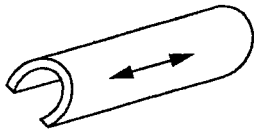

FIGS. 2A, 2B, and 2C illustrate stretch roll formed sheet material. In the examples illustrates, a stretching force is applied predominantly in the direction indicated by the central arrow. The work piece is transformed by the applied force, the geometry, location, and shape of the rollers comprising each of the roller stations. Stretch force can be applied in a direction parallel to or perpendicular to the plane of the contoured shape. The contour can be in the plane of the stretch force (i.e. along a plane perpendicular to the axis of the rollers) as illustrates in FIG. 1, or it can be in a plane perpendicular to the stretch force. The stretch force may be applied by a plurality of relatively short length rollers, each roller having an axis tangential to the local contour. The work piece can be formed to have a double curved surface with a first contour along the direction of the stretch and a second contour perpendicular to the stretch. In addition, the clamping (or normal force) exerted by the rollers can be varied along the direction of the axis of the rollers (along the length of the contour) to result in a curvature in the plane of the sheet. For example, a particular roller can have a contoured profile that may include a taper, a crown or dish-shaped configuration.

Figure 3A:
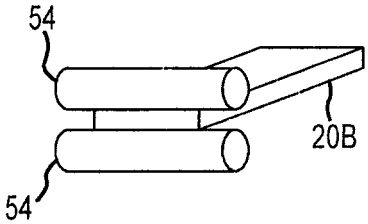
FIGS. 3A, 3B, and 3C illustrate fabrication of a formed work piece.
Figure 3B:
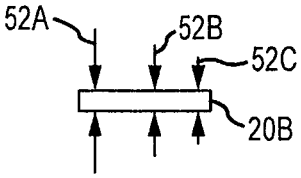
Figure 3C:
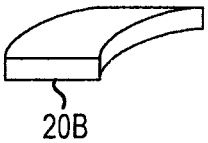

In FIG. 3A, work piece 20A is formed by rollers 54. Rollers 54 can be part of a particular roller station or can be independently controllable. FIG. 3B illustrates the normal forces applied to a work piece 20B by rollers 54. Arrow 52A denotes a large normal force, arrow 52B denotes a medium normal force and arrow 52C denotes a low normal force. The resulting curvature in work piece 20A is illustrates in FIG. 3C.

Figure 4A:
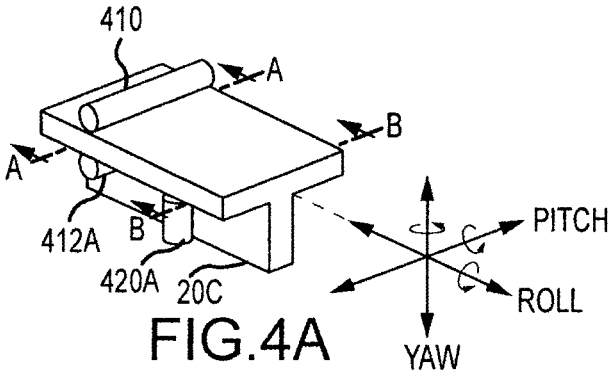
FIGS. 4A, 4B, and 4C illustrate views of rollers and a 'T-channel' work piece.
Figure 4B:
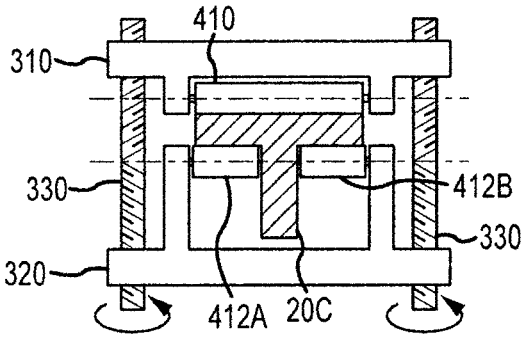
Figure 4C:
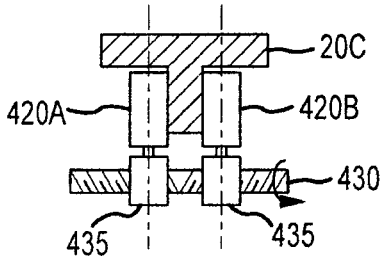

FIGS. 4A, 4B, and 4C illustrate views of rollers and a 'T-channel' work piece. FIG. 4A illustrates a view of roller stations A-A and B-B, having rollers 410, 412A, and 420, among others. Roller station A-A includes roller 410 as well as roller 412A and roller 412B (as shown in FIG. 4B). Rollers 410, 412A, and 412B exert a normal force on the horizontal segment of the work piece 20C. FIG. 4B also illustrates frame element 310 and frame element 320 coupled by threaded shafts 330. Threaded shafts 330 include left-handed thread portion and right-hand thread portion and engage corresponding internal threads of frame elements 310 and 320 to control the compressive normal force exerted on work piece 20C. A plurality of roller stations corresponding to the example illustrates in FIG. 4B can be arranged sequentially and used to form curvature around the pitch axis shown in FIG. 4A.

In FIG. 4B, rollers 412A and 412B have a common axis in parallel with the axis roller 410.

Roller station B-B is illustrated in FIG. 4C and includes rollers 420A and 420B. A threaded shaft 430 engages internally threaded carriers to adjust the spacing of rollers 420A and 420B in order to exert a compressive force on the vertical web of work piece 20C. The threaded shaft 430 includes a left-hand thread portion and a right-hand thread portion. Roller station B-B can be used to form curvature around the yaw axis shown in FIG. 4A. Roller stations A-A and B-B can be used in cooperation to form curvature in the roll axis shown in FIG. 4A. In addition, complex curvature can be formed by combinations of roller stations A-A and B-B.

Roller stations A-A and B-B can be part of a forming station similar to that shown in FIG. 1. The rollers can be configured to have a cylindrical shape or other solid shape. For example, a roller can include an axi-symmetic shape such as the frustum of a cone.

As illustrated in FIG. 4A, a work piece can be formed to have a bend or curvature denoted by roll, pitch, and yaw. A particular bend can be formed by exerting a stretching force and a rolling force using a series of rollers (such as those of roller station A-A and roller station B-B) configured with a particular location and orientation. Rollers 420A and 420B can be configured to engage the vertical leg (web) with sufficient compressive force to maintain substantially uniform alignment of the leg while avoiding buckling, kinking, or collapsing of the leg or to increase the stretch exerted by the cumulative effect of rollers or other roller stations.

Rollers of individual roller stations can be repositioned. Repositioning permits changing the location and the orientation of axes. In addition, different roller stations can be repositioned in order to control or follow the movement of the work piece as it progresses through the forming system.

The rollers exert a compressive force in order to achieve a slight thinning of the cross section of the work piece. The compressive force induces a compressive residual stress at the surface of the work piece. The rollers may include rubber coated metal wheels or elastic wheels. Each roller is interchangeable or selectable in order to accommodate a variety of different cross-sections of the work piece.

A work piece can be formed by changing the location of the roller stations as the work piece moves with respect to the roller stations. In this configuration, the pitch, roll, and yaw can change smoothly.

Figure 4D:
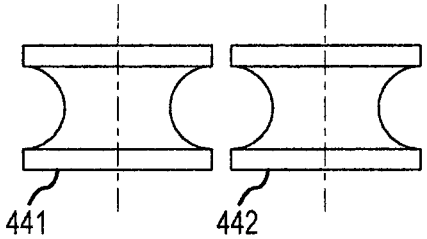
FIG. 4D illustrates a set of rollers having a convex profile.

FIG. 4D illustrates rollers 441 and 442 having a convex profile. Rollers 441 and 442 rotate on parallel axes. The convex profile may be suitable for forming a work piece having a circular cross section. The work piece can be tubular (such as pipe) or solid round section (such as wire or rod). Other roller configurations are also contemplated including complex face profiles tailored for forming a particular work piece. The examples illustrated include face profiles that match the particular work piece as well as other profiles that can be used to produce desired changes in the geometry of the cross-sectional shape.

Figure 5A:
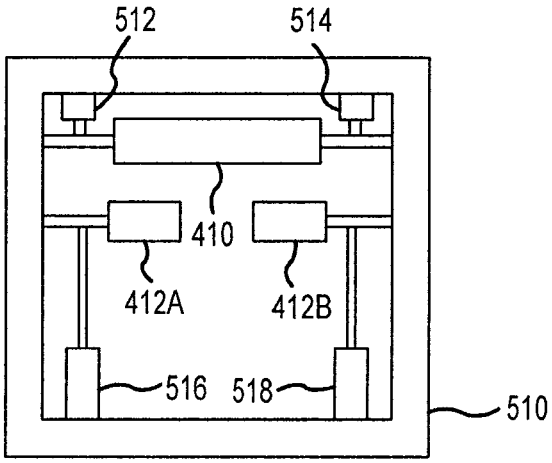
FIGS. 5A and 5B illustrate roller stations.

As shown in FIG. 5A, rollers 410, 412A, and 412B are coupled to a frame 510. The frame transmits equal and opposite roll forces (the normal forces) at each roller station. The rollers can be built around, or inside of, frame 510. For instance, the frames for the sets of rollers 410, 412A, and 412B at each roller station can be combined into one rigid body. In this configuration, the frame 510 takes up the equal and opposite roll forces (the normal forces) exerted by each pair of rollers and a mechanism can be configured to position the frame (station) at a particular location and orientation. The mechanism supplies the net tensile force at each particular station. Such a mechanism includes adjustable length links coupled between neighboring stations and having joints at the connections to the frame at each station. This configuration carries the compressive forces to react to the tensile force through the work piece.

Frame 510, shown in FIG. 5A, is configured to form a work piece in a manner corresponding to the roller station of FIG. 4B. Adjustable links 512 and 514 are coupled to roller 410 and can be configured to independently, or jointly, adjust alignment and position of the axis of roller 410. In a similar manner, adjustable links 516 and 518 are coupled to rollers 412A and 412B, respectively, and can be configured to independently, or jointly, adjust alignment and position of the axis of roller 412A and the alignment and position of the axis of roller 412B.

Figure 5B:
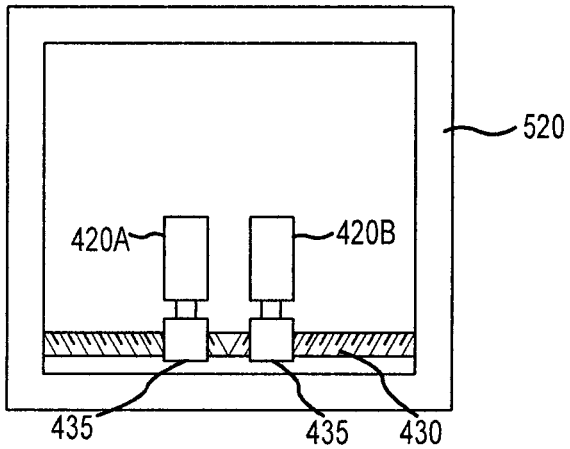

Frame 520, shown in FIG. 5B, is configured to form a work piece in a manner corresponding to the roller station of FIG. 4C. Shaft 430 is coupled to carriers 435 which carry rollers 420A and 420B. Rollers 420A and 420B can be moved together or apart by rotation of shaft 430. Frame 520 carries the load exerted by the rollers 420A and 420B.

Figure 6A:
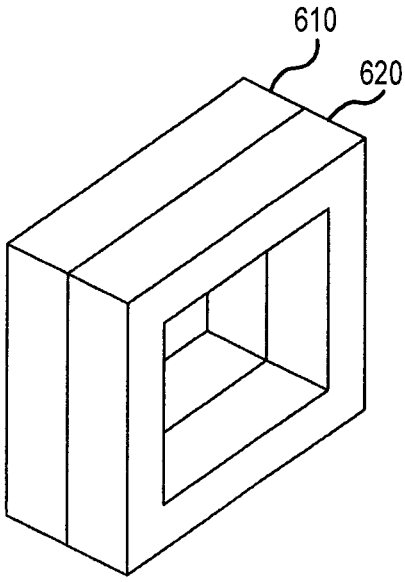
FIGS. 6A and 6B illustrate roller stations.

FIG. 6A illustrates frame 610 coupled to frame 620. Frame 610 and frame 620 can include a roller station as described elsewhere in this document. A work piece can be passed through the frames and formed by stretch rolling. In FIG. 6A, the frames are shown to be held in a fixed alignment.

Figure 6B:
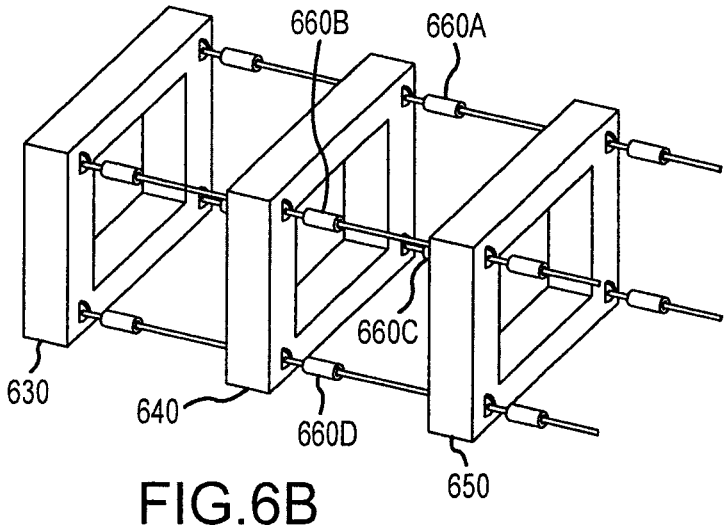

In FIG. 6B, frames 630, 640, and 650 are in adjustable alignment. Adjacent frames are coupled by a system of adjustable links. Frame 640 is coupled to frame 650 by links 660A, 660B, 660C, and 660D. A greater or smaller number of links can be used and in one example, the ends of the links are terminated with an articulating joint, such as a spherical or a universal joint.

Links 660A, 660B, 660C, and 660D can include a threaded shaft, a hydraulic shaft, a pneumatic actuator or other type of adjustable linear element. The links are operated to adjust the alignment and relative position as to adjacent frames, and thereby control the contour formed by passage of the work piece.

An orienting mechanism may be employed to control the orientation of the frame at each roller station. For example, an articulating mechanism, such as a robot or a similar structure, provides the reaction force to support the traction force exerted by the rollers on the work piece.

In one embodiment including an articulating mechanism, a link is coupled between adjacent frames to take up the traction force and to reduce the loading on the articulating mechanism. The link can include spherical joints or universal joints at one end or at both ends. In this configuration a robot provides the moment to react to the load exerted by the offset between the axes of the work piece and the link joining the neighboring frames.

The relative orientation of adjacent frames is controllable by a system of links coupling the adjacent frames. The system of links can include a link with a spherical joint along with at least one other link having an adjustable length. For instance, adjacent frames are coupled by a link having a spherical or universal joint and two or more links having an adjustable length. The length of a link can be adjusted by a hydraulic cylinder or by a threaded screw mechanism. The links between adjacent frames can be oriented and spaced around the work piece to control the relative origination of the neighboring stations and to sustain the forces and moments exerted by the work piece.

In addition to the opposing roller configurations shown in some of the Figures, other configurations, including non-opposing rollers, are also contemplated. For example, one roller configuration can form a work piece having a variety of cross sections. Some examples of cross sections include angle stock, I-beam, and hat channel. The cumulative effect of the rollers at each of the roller stations are used to grip the work piece and to stretch the work piece, and the relative location and orientation of the roller stations can be controlled to produce a part having a specified geometry.

The set of rollers within the frame of a roller station can be controlled. For example, the location of at least one of a part of opposing rollers can be selected to control the roll force or the normal or clamping force exerted by the pair of rollers.

A mechanism such as a hydraulic cylinder or a screw can be provided within a frame so that the location of the rollers can be controlled and changed in order to form the work piece. The work piece can be gradually changed in the size or shape of its cross-section either from one run to the next, or within the run for each work piece. The work piece can be passed through a progressive series of roller stations or the roller stations can be moved over the work piece.

Figure 7A:
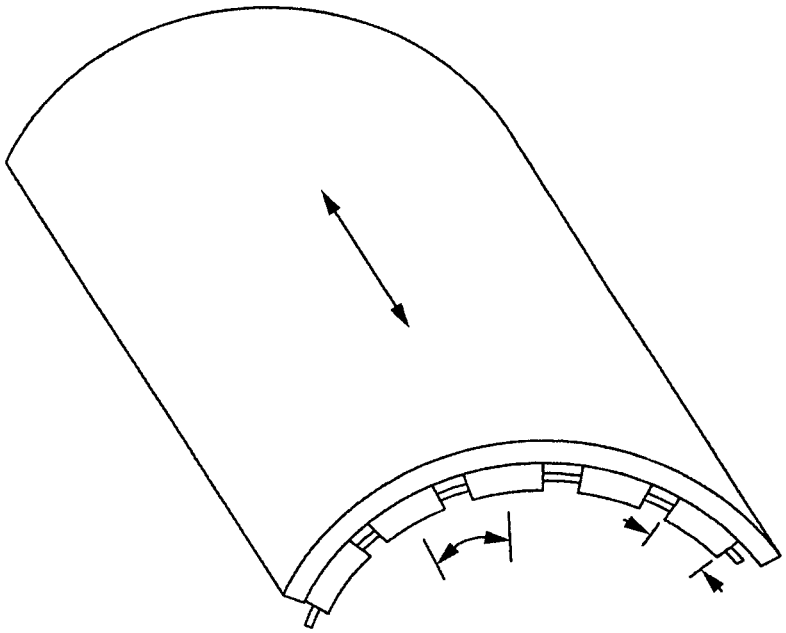
FIGS. 7A and 7B illustrate work pieces and selected rollers.

The configuration of a roller can be selected to achieve a particular result. As shown in FIG. 7A, the length of the roller can be selected to enable formation of a curved panel. The roller length is increased and the roller profile is configured to correspond with the finished contour. An increased roller length can result in a reduction in the number of motors at each station. However, the spacing between rollers of a particular frame at a particular roller station having rollers distributed around the perimeter of the cross-section, would increase and the curvature of the work piece would only be approximately enforced by the rollers.

Figure 7B:
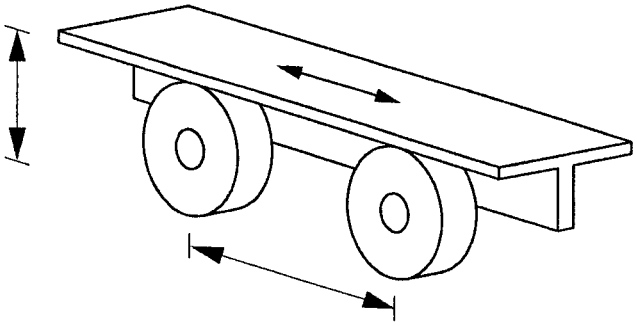

In the example shown in FIG. 7B, the diameter of the rollers is increased to reduce the number of roller stations for a given forming operation. However, an increased rolled diameter is accompanied by an increased spacing between adjacent stations, that is, in the length direction of the work piece. Furthermore, an increased roller diameter may lead to stress non-uniformity throughout the work piece and to an increased minimum length for the work price.

Other configurations for the present subject matter are also contemplated.

The individual or discrete rollers in a roller station are separately powered. This configuration may not be suitable for certain applications. For example, the acquisition and maintenance costs for individually powered rollers, such as a combination of a motor and a roller, may be burdensome. In addition, the roll forces exerted on a work piece may not be uniformly distributed along the cross section of the work piece or along the length of the work piece.

Figure 8B:
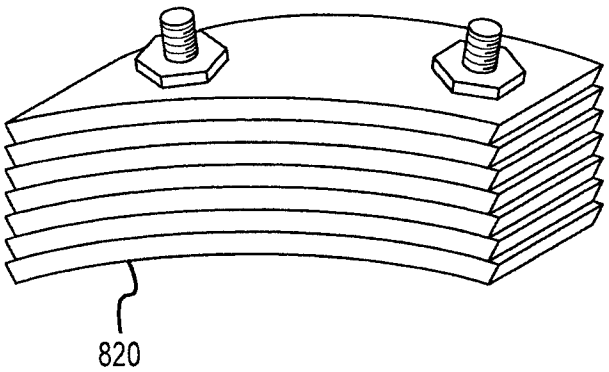
FIGS. 8A and 8B illustrate plate stacks.
Figure 8A:
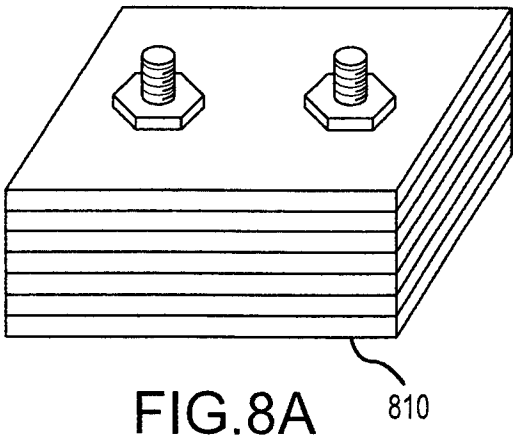
Figure 9:
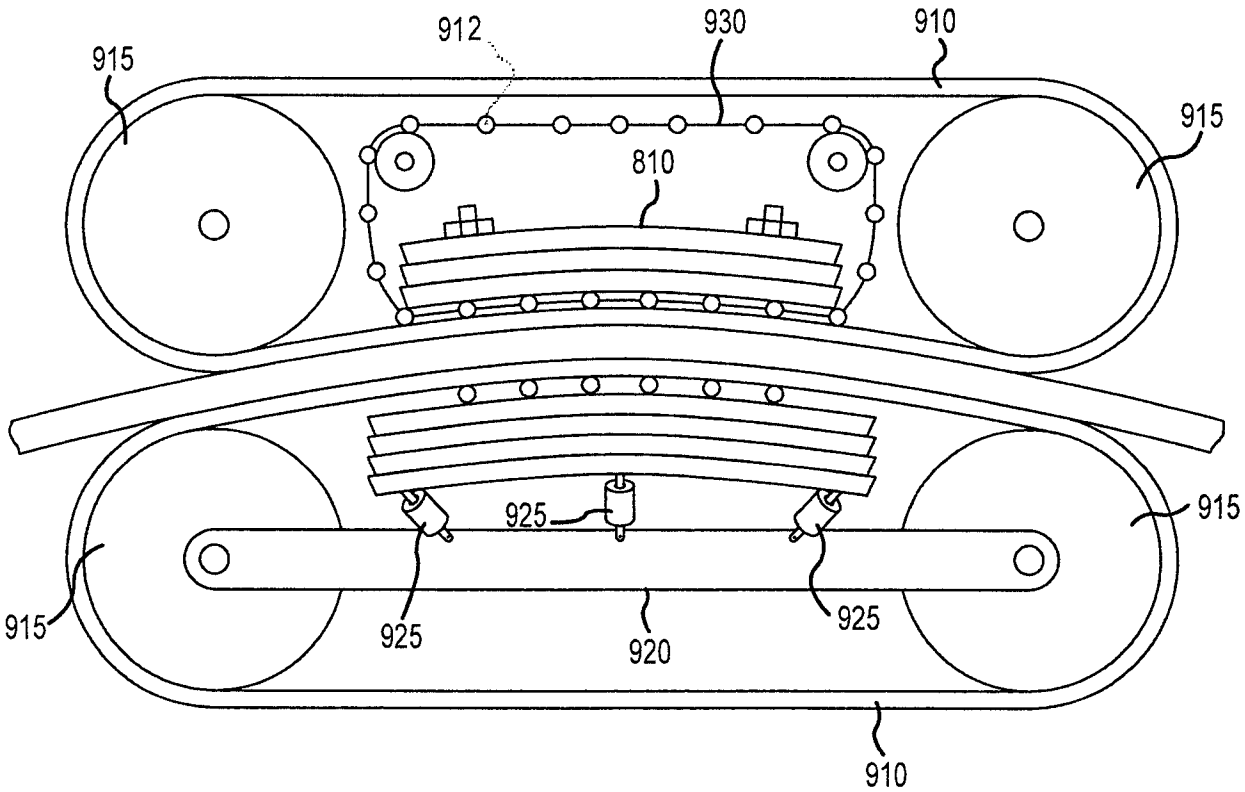
FIG. 9 illustrates a track roller configuration.

A track element may be configured to contact the work piece over a relatively large area rather than small area of contact provided by individual rollers. The track element can be support in a curved configuration using the reinforcing structure illustrated in FIGS. 8A and 8B. In FIG. 8A, stack 810 is generally planar and is retained in position by the clamping force exerted by a pair of threaded fasteners. In FIG. 8B stack 820 is also held in a curved configuration by a pair of threaded fasteners. The track element 910 resembles those in a tracked vehicle, as shown in FIG. 9. The track elements serve to increase the area across which the load or force is exerted and may provide a more uniform distribution of loading. Track element 910 is configured to apply a normal force and a tensile traction to the surfaces of a sheet-type or an extrusion-type work piece in a manner that allows increased uniformity of the normal and traction forces.

Consider an example in which the curvature of the cross section of the work piece is small or negligible so that only the contour in the plane of the bend is important. In this case, the contour in the plane of the bend (for example, the length direction of the work piece) is controlled. The rollers 912 are configured as needle rollers, that is, a high aspect ratio in which the roller length is much longer that the roller diameter, which press on the inner surface of an endless belt or the track element 910. The endless belt 910 is driven by two large rollers 915. The normal force that presses the needle rollers 912 into the belt is provided by a flexible raceway or stack 810 located on the interior of the belt. The flexible raceway stack 810 includes a laminated stack of well-lubricated, smooth sheets such as shown in FIGS. 8A and 8B. The sheets are bent easily by applying a suitable force or moment and then locked in position by means for arresting the relative sliding motion of the sheets. The force for pressing the raceway onto the rollers may be provided by a bladder placed inside the belt or it could be provided by small hydraulic cylinders 925 such as those used in a fixturing system. The rollers 912 are coupled together by a drive chain 930. The drive chain is routed around a circumference within the perimeter of the belt 910 so that the rollers do not have to travel around the pulleys driving the belt.

Since low sliding speeds may suffice under most conditions, the rollers 912 may be eliminated under well lubricated conditions and in that case the normal force is exerted on the raceways and thereby against the rubber belt 910. In another embodiment, the rollers are attached to the plates and the rollers rotate about their own axis. This configuration may be suitable for an application utilizing larger diameter rollers where the length of the rollers is of the order of their diameter. The rollers may have a cambered profile to improve the uniformity of the normal stress applied. Rather than using a roller, a rotatable ball may be held in position. In that case the roller or the ball is coupled with compliance of the raceways to allow bending in the plane including the axis of the rollers. This configuration may improve the uniformity of normal stress exerted on the work piece. The uniformity of stress exerted by the belt can be improved by increasing the thickness of the belt and by having segmented pieces of softer rubber facing on the steel belted rubber tread portion that is driven by the rollers. Where the curvature of the cross-section of the work piece is small, a plurality of tractor elements can be configured to act on different chords of the cross-section in order to affect the traction for stretch bending.

Figure 10:
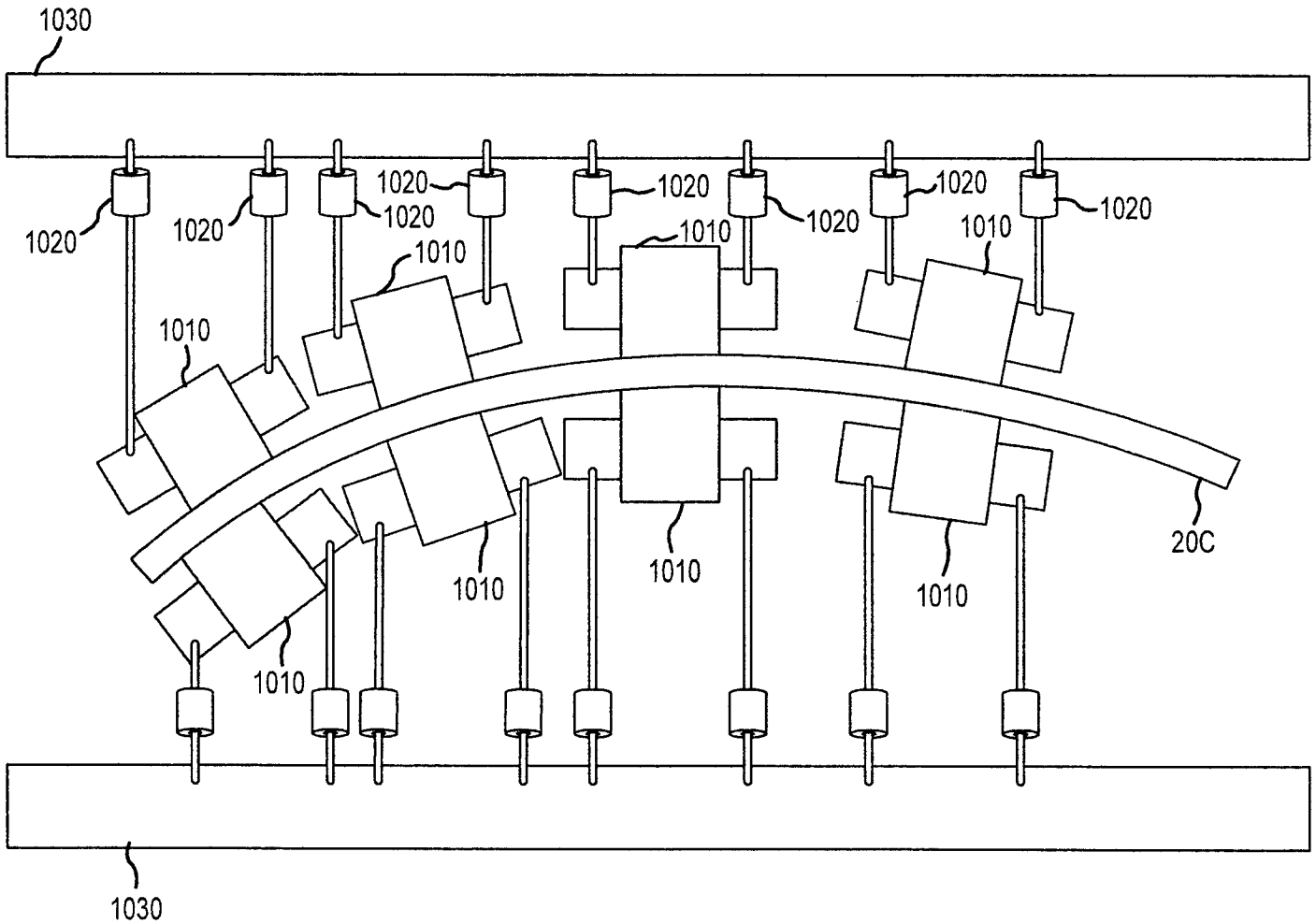
FIG. 10 illustrates a roller station.

FIG. 10 illustrates a configuration of rollers in which the position and alignment of individual rollers is independently selectable. Work piece 20C is formed using rollers 1010, each of which is positioned by a first and second links 1020. Links 1020 are coupled to a frame 1030 and are linearly adjustable to achieve a desired force and forming pressure.

Figure 11A:
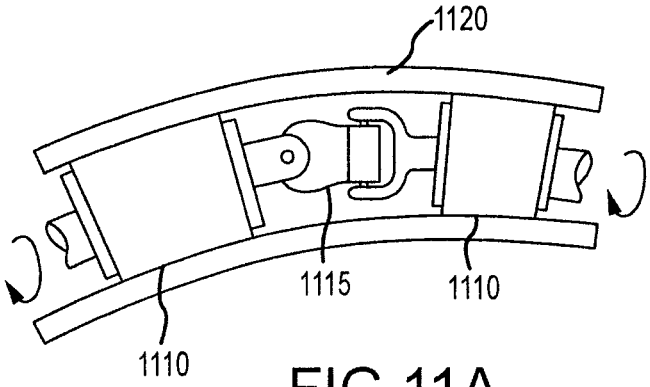
FIGS. 11A and 11B illustrate rollers.

FIG. 11A illustrates apparatus configured for forming a work piece in which the curvature of the cross-section of the work piece is high and changing and the curvature in the length direction of the work piece remains small. For instance, a leading edge skin for a wing formed from initially flat sheet stock will have high curvature in one direction and little curvature in a perpendicular direction. In this apparatus, rigid rollers 1110 are spaced around the circumference at each station and adjacent rollers are interconnected using flexible coupling 1115 such as a universal joint configured to transmit torque from one roller to the next roller. The flexible coupling arrangement reduces the number of necessary drive motors. The shape of the set of rollers is controlled by individually controlling the location of the rollers or by controlling the shape of a flexible raceway which exerts a force on the rollers. The rollers may have individual rubber liners and in one embodiment a single belt envelopes the rollers in the length direction. Such a belt may also envelop rollers at more than one cross-section, if the curvature from section to section changes gradually. In FIG. 11A, sheath 1120 includes a belt or an elastic sleeve that provides a greater area of contact with the surface of the work piece.

Figure 11B:
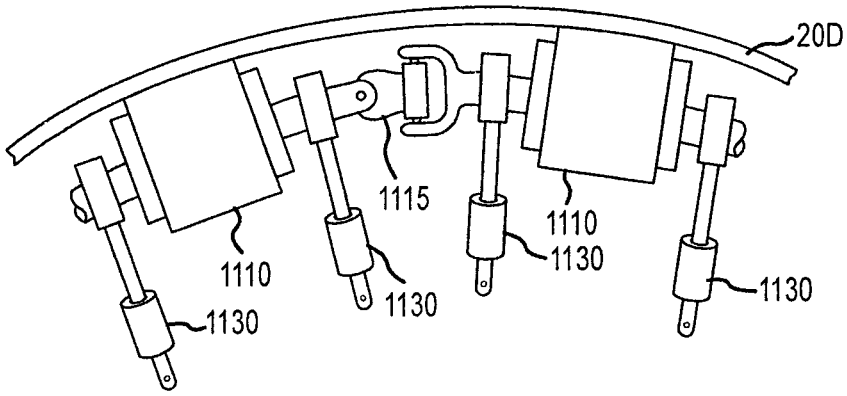

FIG. 11B illustrates apparatus in which rollers 1110 are coupled by a flexible coupling 1115 and further supported by adjustable links 1130. Work piece 20D is formed by stretch roll forming via a normal force exerted by the adjustable links 1130.

Figure 12A:
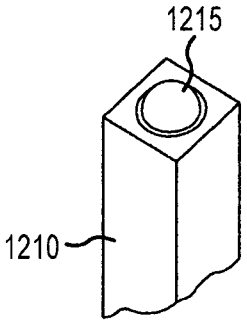
FIGS. 12A, 12B, and 12C illustrate linear element rollers.
Figure 12B:
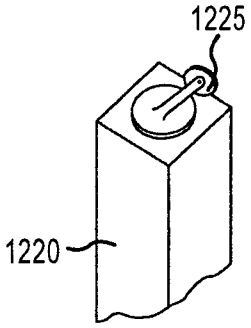
Figure 12C:
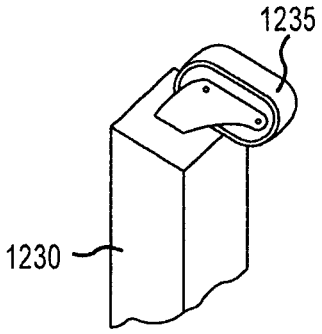

FIGS. 12A, 12B, and 12C illustrate various configurations for linear elements suitable for use with the method of the present invention. A linear element, such as those referenced at 1210, 1220, and 1230, is fixed at a proximal end and includes a bearing surface, such as 1215, 1225, and 1235, disposed at a distal end. Bearing surface 1215 includes a captivated ball. Bearing surface 1225 includes a roller on an axis aligned substantially normal to the main axis of the linear element 1220. The bearing surface can be offset from the main axis, similar to a castor wheel, to improve alignment and ease passage of a belt, as illustrated by bearing surface 1235.

Figure 13:
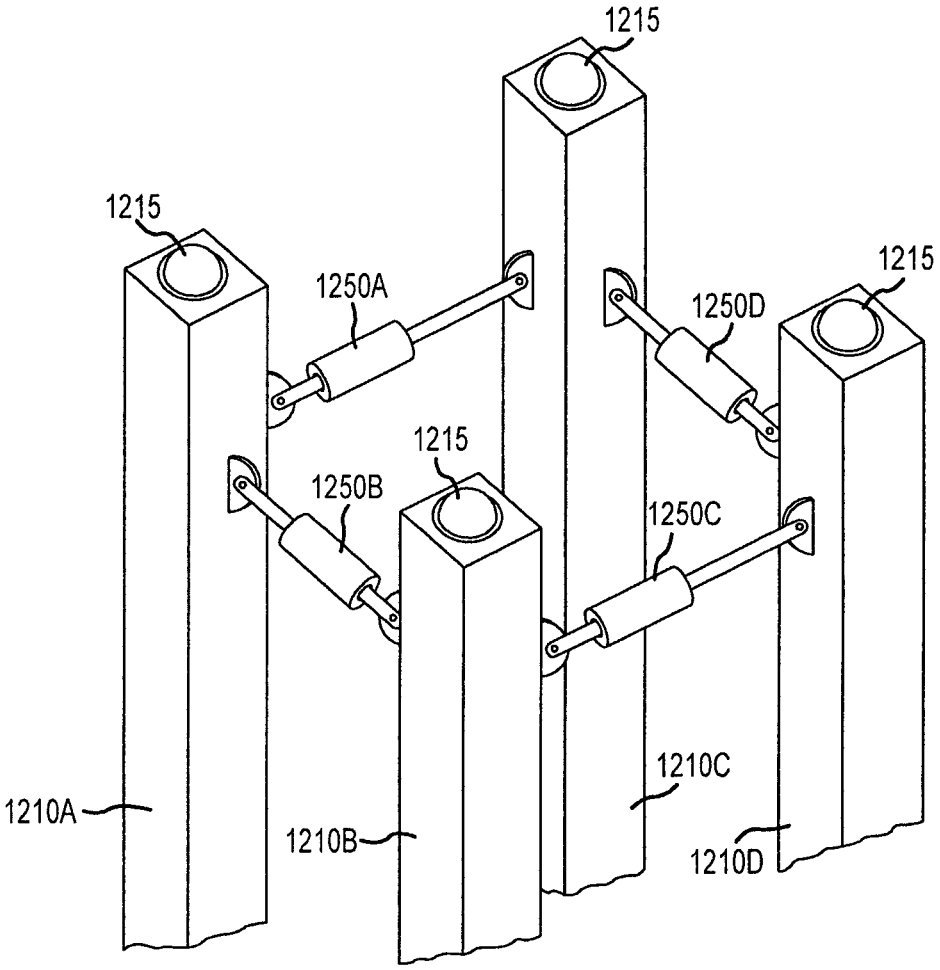
FIG. 13 illustrates an arrangement of linear element rollers.

FIG. 13 illustrates a number of linear elements 1210A, 1210B, 1210C, and 1210D held in fixed alignment. The spacing between adjacent linear elements is controlled by interconnecting links comprising hydraulic cylinders 1250A, 1250B, 1250C, and 1250D. The height of each bearing surface 1215 and the track element or belt is positioned in the desired configuration. The links 1250A, 1250B, 1250C, and 1250D between adjacent linear elements supply a force holding the linear elements together or apart at the desired distances.

The described track elements are suitable for accurately forming a work piece in which the local curvature at each cross-section is relatively high. The track elements may also allow forming of a work piece having a widely varying curvature from one cross-section to another along the length of the work piece.

In addition to stretching and forming, other fabrication procedures can also be performed. For example, and with reference again to FIG. 1, a fabrication procedure can be performed before passing work piece 20A through system 10A, between selected roller stations of system 10A, or after passing work piece 20A through the system.

What is claimed is:

1. A method of applying traction forces to a surface of a work piece through at least two grips comprising, contacting the work piece with the at least two grips over two or more contact regions along which the surfaces of the work piece and the at least two grips are substantially conformal and where the at least two grips and the work piece exert normal forces on each other, where at least two traction forces are transmitted to the work piece, wherein contact between the at least two grips and the work piece occurs at two or more rollers, balls, or tractor elements which are pressed onto the surface of the work piece and are driven so as to apply the at least two traction forces to the work piece, where the at least two traction forces act in opposing directions and stretch an entire cross-section of the work piece over a stretching region; and simultaneously plastically deforming the stretching region to bend the work piece to have a radius along at least one of a yaw axis, a pitch axis, and a roll axis.

2. A method of applying traction forces to a top and bottom surface of a work piece comprising:

providing first sets of rollers disposed proximate to each of the top and bottom surfaces of the work piece, where each of the first sets of rollers comprises at least one roller;

enveloping the first sets of rollers proximate to the top surface of the work piece by a first endless loop tractor belt;

enveloping the first sets of rollers proximate to the bottom surface of the work piece by a second endless loop tractor belt;

said first and second tractor belts each having inside and outside surfaces;

providing one or more flexible raceway surfaces disposed proximate the inside surface of each tractor belt;

providing second sets of rollers between each of the flexible raceway surfaces and the inside surface of the respective tractor belt through which the flexible raceway surface acts to press a portion of the outside surface of the respective tractor belt against the respective surface of the work piece, wherein each of the one or more flexible raceway surfaces are bendable between configurations of different curvature, and each of the second sets of rollers are routed around a circumference within a perimeter of the respective tractor belt; and controlling a torque applied to at least one roller of each of the first sets of rollers to drive the endless belts.

* * * * *

UNITED STATES PATENT AND TRADEMARK OFFICE

CERTIFICATE OF CORRECTION

PATENT NO. : 9,221,088 B2
APPLICATION NO. : 12/763819
DATED : December 29, 2015
INVENTOR(S) : Vis Madahavan and Mahdi Saket It is certified that error appears in the above-identified patent and that said Letters Patent is hereby corrected as shown below:

Title page, Item (73) Assignee, please delete "FAIRMONT", and insert --FAIRMOUNT--.

Signed and Sealed this
Thirty-first Day of May, 2016

Michelle K. Lee

Michelle K. Lee
*Director of the United States Patent and Trademark Office*